United States Patent [19]

Gross et al.

[11] 3,984,723

[45] Oct. 5, 1976

[54] DISPLAY SYSTEM UTILIZING BEAM SHAPE CORRECTION

[75] Inventors: Josef Gross, Princeton; William Henry Barkow, Pennsauken, both of N.J.

[73] Assignee: RCA Corporation, New York, N.Y.

[22] Filed: Oct. 4, 1974

[21] Appl. No.: 512,226

[52] U.S. Cl. ..... 313/412; 313/413

[51] Int. Cl.[2] ..... H01J 29/51; H01J 31/20

[58] Field of Search ..... 313/409, 412, 413, 414, 313/453, 415

[56] References Cited

UNITED STATES PATENTS

| | | | |
|---|---|---|---|
| 3,579,010 | 5/1971 | Jones | 313/453 X |
| 3,603,839 | 9/1971 | Takayanagi | 313/414 X |
| 3,772,554 | 11/1973 | Hughes | 313/414 X |
| 3,800,176 | 3/1974 | Gross et al. | 313/412 X |

OTHER PUBLICATIONS

B381,074, Jan. 1975, Hasket et al., 313/414 X.

*Primary Examiner*—Robert Segal

*Attorney, Agent, or Firm*—Eugene M. Whitacre; Paul J. Rasmussen

[57] ABSTRACT

A color picture reproducing tube utilizes three coplanar electron beams. Convergence of the three beams along at least one axis is accomplished by a deflection assembly producing a magnetic deflection field with particular astigmatism characteristics which also elliptically distorts each of the three beams in a first direction. The electron gun assembly within the picture tube includes apertured electrodes which predistort the beams elliptically in a second direction orthogonal to the first direction of distortion.

7 Claims, 15 Drawing Figures

DISPLAY SYSTEM UTILIZING BEAM SHAPE CORRECTION

BACKGROUND OF THE INVENTION

This invention relates to a color display system utilizing an astigmatic deflection field for in-line beam convergence and predistortion of each beam shape for compensation for deflection-induced beam distortion.

In the past convergence of the beams of color picture tubes, such as used in color television receivers, generally has been accomplished by the use of magnetic pole pieces disposed within the neck of a picture tube and energized by external electromagnets driven by convergence correction waveforms at both the line and field scanning rates to effect convergence of the beams as seen on the viewing screen of the picture tube. This is commonly referred to as on-axis dynamic convergence correction. Additionally, sometimes to correct corner misconvergence it has been necessary to utilize further correction waveforms derived by combining the line and field rate waveforms. Obviously, structure of this type is expensive and usually requires the adjustment of many controls to properly converge the beams.

Color picture tubes utilizing coplanar beams horizontally disposed, and particularly in conjunction with vertically disposed phosphor stripes on the viewing screen, have enabled the use of dynamic convergence arrangements which are simpler than the above-described arrangements utilized with picture tubes having delta electron beam configurations and dot phospher elements arranged in triad groupings. It is known that quadrupole magnetic field-producing windings may be utilized in conjunction with the deflection yoke to achieve convergence of the coplanar beams. In general the quadrupole windings must be energized by both line and field rate waveforms and a number of adjustable control elements utilized to achieve the desired convergence of the beams. Alternatively, in addition to a quadrupole winding, the scanning current through the actual deflection windings may be proportioned to achieve convergence, but this approach also requires a number of adjustable controls, all of which add to the cost and complexity of manufacturing and servicing the television receiver.

In U.S. Pat. No. 3,800,176 entitled, "SELF-CONVERGING COLOR IMAGE DISPLAY" and issued Mar. 26, 1974, to the present inventors, a system is described which provides self-convergence of three coplanar beams of a color picture tube without the use of any dynamic convergence apparatus. That patent also discloses that in relatively large viewing screen size picture tubes, such as tubes having a viewing screen diagonal dimension of about 25 inches, it may be desirable to utilize some form of simplified dynamic convergence arrangement to achieve substantial convergence of the beams at all points on the viewing screen.

The self-converging feature of the three in-line beams is provided by producing astigmatic deflection fields, the field generally being a pincushion shaped field produced by the horizontal deflecting components and a barrel shaped field produced by the vertical deflecting components. This astigmatism is produced and controlled by the conductor distribution of the wound components placed about the neck region of the picture tube. This self-converging feature is extremely desirable in that it eliminates or, in the case of simplified dynamic convergence systems, greatly reduces the amount of dynamic convergence circuitry and the attendant set-up and servicing time. However, with picture tubes utilizing wider deflection angles such a 110° and larger viewing screens such as screens having a diagonal measurement of about 63 cm, and whether or not some form of simplified dynamic convergence is utilized in conjunction with the self-converging characteristics of the wound components, the electron beam shape may undesirably distort from a substantially circular spot at the center region of the viewing screen to a horizontal ellipse as a function of distance along the horizontal deflection axis. Under these conditions horizontal resolution of the display system may be impaired to the extent that the reproduced picture is commercially unacceptable.

SUMMARY OF THE INVENTION

In accordance with the invention a color display system utilizing beam shape correction includes a color picture tube including a coplanar electron beam gun assembly mounted within the tube for producing three beams for impinging on a phosphor element screen of the tube. Means are provided for statically converging the beams at the central region of the phosphor screen. A deflection yoke assembly is mounted in operating relation about the neck of said tube and the conductor distribution of the yoke assembly is selected for producing a pincushion-shaped horizontal deflecting field for causing said three beams to be substantially converged along the horizontal deflection axis and which astigmatism also causes each of the beams to spread horizontally as they reach the phosphor screen when deflected horizontally away from the center of the phosphor screen. The electron gun assembly includes apertures in at least one electrode being vertically elliptically shaped for forming vertically elliptically shaped beams at the center of the phosphor screen for reducing the horizontal distortion of said beams caused by said deflection assembly.

A more detailed description of the invention is given in the following specification and accompanying drawings of which:

FIG. 1 is a sectional view of a display system embodying the invention;

FIGS. 2*a*–2*c* illustrate the horizontal deflection magnetic fields utilized in the system of FIG. 1;

FIGS. 3*a*–3*c* illustrate the vertical deflection magnetic fields utilized in the system of FIG. 1;

Figure 1:
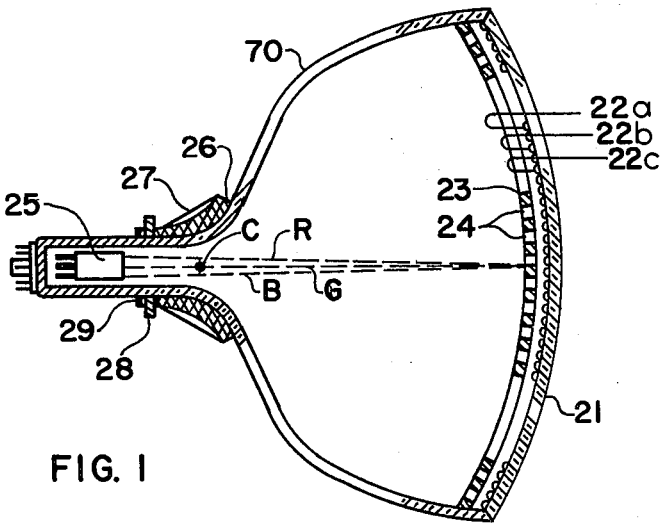
Figure 7:
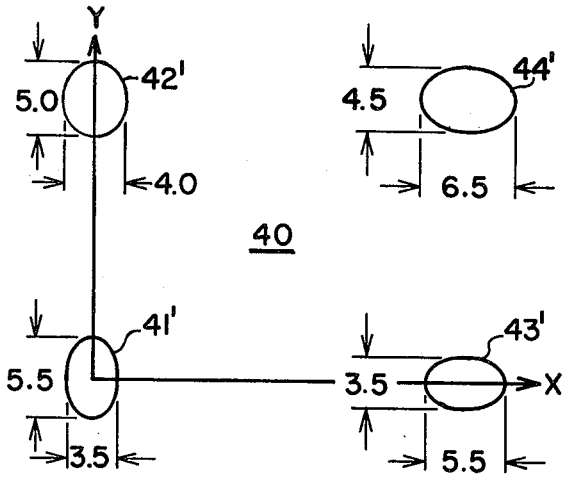
Figure 6A:
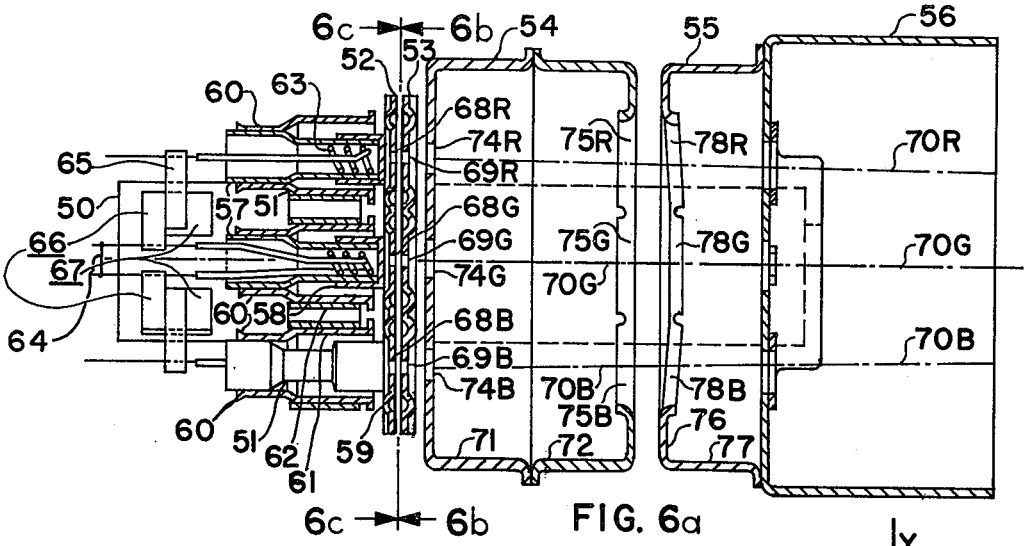
Figure 6C:
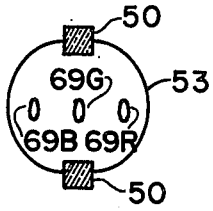
Figure 6B:
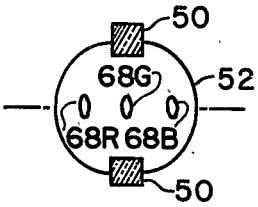
Figure 8B:
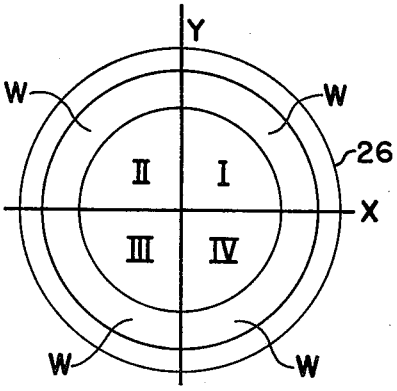
Figure 8A:
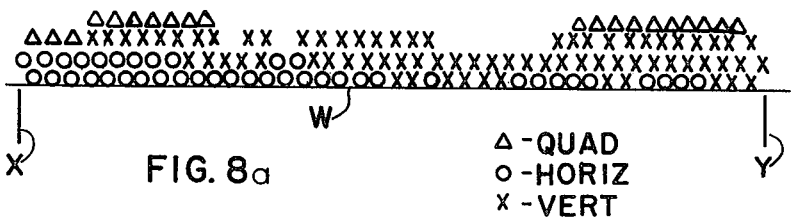

FIGS. 6*a*–6*c* illustrate an electron gun assembly utilized in the system of FIG. 1;

FIG. 7 illustrates the beam spot condition observed on the picture tube in the system of FIG. 1; and FIGS. 8*a* and 8*b* illustrate the conductor distribution of a deflection yoke suitable for use in the system of FIG. 1.

DESCRIPTION OF THE INVENTION

FIG. 1 is a top sectional view of a display system embodying the invention. A color picture tube 20 includes a glass envelope 70 and a faceplate 21. Deposited on the inside of the surface of faceplate 21 are a series of repeating groups of blue, green and red phosphor elements 22*a*, 22*b* and 22*c*. Disposed in the neck region of picture tube 20 is an electron gun assembly 25 which produces three coplanar horizontal beams B, G and R which pass through apertures 24 of an aperture mask 23 to impinge upon the respective color phosphor elements. Disposed around the neck region of picture tube 20 is a deflection yoke including a ferrite core 26 having wound thereon conductors 27 forming the vertical and horizontal deflection coils. The deflection yoke itself may include quadrupole magnetic field producing conductors which will be described subsequently. Located behind the deflection yoke about the neck of the picture tube is a static convergence assembly 28 which may be of any suitable type producing adjustable quadrupole and hexapolar fields for aligning the two outside ones of the electron beams relative to the center electron beam. Located behind static convergence assembly 28 is a color purity adjusting device 29. This device may comprise two rotatable metal rings, each of which is magnetized with opposite poles across its diameter. The color purity ring assembly 29 serves to move all three of the in-line beams together. It is to be understood that the static convergence assembly 28 and color purity assembly 29 may be separate assemblies, as illustrated here, or may be combined in one unit.

Figure 2A:
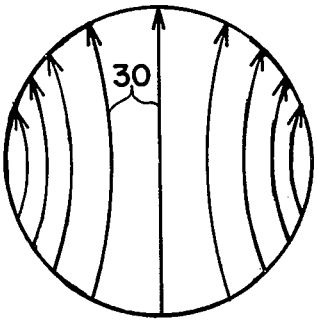
Figure 2B:
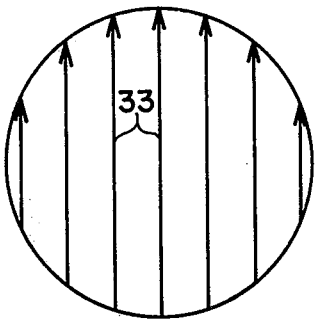

FIG. 2*a* illustrates the deflection field produced by the deflection yoke assembly of FIG. 1 required to deflect the electron beams horizontally and simultaneously provide self-convergence of the beams along the horizontal deflection axis without requiring additional dynamic convergence correction apparatus. It can be seen that the magnetic flux lines 30 form a pincushion shaped deflection field which increases in intensity in horizontal directions away from the center of the field. The net horizontal deflection field illustrated in FIG. 2*a* is comprised generally of the addition of the component field illustrated in FIGS. 2*b* and 2*c*. In FIG. 2*b* a uniform deflection field such as the integrated field produced by horizontal deflection coils exhibiting anisotropic astigmatism is illustrated. The deflection force is at a right angle to the vertically disposed uniform lines of flux 33. Such a uniform field, acting upon three electron beams which were converged at the center of the phosphor screen by a conventional static convergence assembly would result in the beams being overconverged as they are deflected away from the center of the screen in a horizontal direction due to the image field curvature. To converge the beams along the horizontal axis some force must be exerted on the beams to pull them apart to compensate for the over-convergence caused by the effects of image field curvature. As taught in the aforementioned patent, this may be accomplished by making the net horizontal deflection field astigmatic. Specifically, the field must have the negative horizontal isotropic astigmatism characteristic illustrated in FIG. 2*a*. This astigmatic field may be achieved in several ways.

Figure 2C:
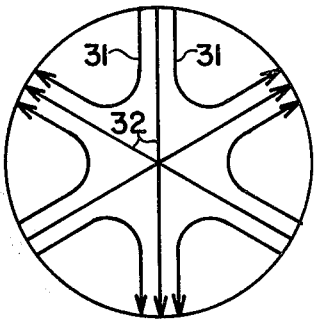

As illustrated in FIG. 2*c*, a hexapolar field may be generated by the third harmonic energy of the energized horizontal deflection coils by properly placing the coil conductors in the deflection yoke. An illustrative example of a suitable conductor distribution is shown in FIGS. 8*a* and 8*b*. The flux lines 31 of FIG. 2*c* are concentrated generally along the lines 32 and combine with the uniform field of FIG. 2*b* to yield the required astigmatic deflection and self-converging field of FIG. 2*a*. Instead of a hexapolar field, a quadrupole winding, which may be wound on the deflection yoke along with the deflection coils or which may be a separate wound component mounted around the picture tube adjacent the deflection yoke, may be utilized for producing the nonuniform field component for achieving self-convergence. The four poles of such a winding would be located approximately 45° offset from the horizontal and vertical deflection axes. The proper field will be produced when this winding is energized by horizontal rate current. For example, the quadrupole winding would require a generally parabolic current and the hexapole winding would require a sawtooth current which is the normal scanning current.

Of course the three beams must be converged at all points on the raster and not just along the horizontal axis. Even when the beams are converged along the horizontal axis in accordance with the discussion in conjunction with FIGS. 2*a*–2*c*, the beams are overconverged in the corners of the raster and at the ends of the vertical deflection axis and, additionally, some trap will be present. Trap refers to a condition in which horizontal lines are separated at places other than along the two deflection axes. To correct these conditions the astigmatic characteristic of the vertical deflection field must also be controlled.

Figure 3A:
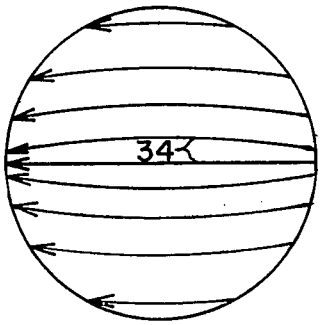
Figure 3B:
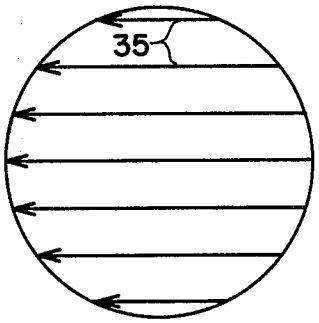
Figure 3C:
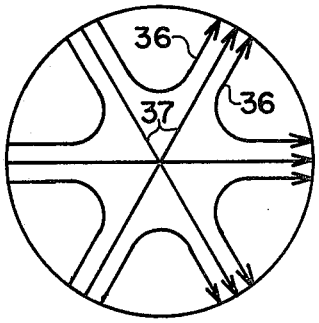

FIGS. 3*a*–3*c* illustrate the characteristics of the vertical deflection field. FIG. 3*a* illustrates the net deflection field which is barrel shaped and therefore exhibits a positive vertical isotropic astigmatism characteristic. The lines of flux 34 are more crowded toward the center of the field and the field intensity diminishes in vertical directions away from the center. This field exerts a force on the three beams which tends to correct the horizontal overconvergence condition of the beams in the corners and top and bottom portions of the phosphor screen. The field of FIG. 3*a* is comprised of the superimposed fields of FIGS. 3*b* and 3*c*.

In FIG. 3*b* a uniform vertical deflection field comprising lines of flux 35 extending in horizontal directions is shown. Such an anastigmatic field would deflect the beams but would not correct for the horizontally overconverged and trap beam conditions in the top and bottom portions of the scanned raster. FIG. 3*c* illustrates a hexapolar field comprising lines of flux 36 which results in a concentration of the field in the directions of the arrows on lines 37. This field provides the nonuniformity, which, when added to the uniform field of FIG. 3*b*, produces the desired converging and deflection field of FIG. 3*a*. The hexapolar field of FIG. 3*c* is generated by the harmonics of the energy in the vertical deflection coils when energized and may be produced by suitably placing the vertical deflection coil conductors about the ferrite core of the deflection yoke as illustrated in FIGS. 8*a* and 8*b*.

Figure 4:
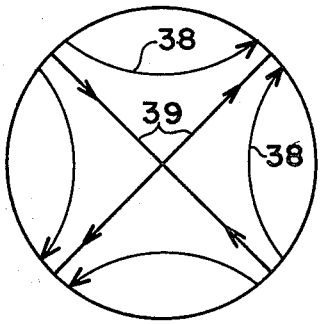
FIG. 4 illustrates a quadrupole magnetic field utilized in the system of FIG. 1.

Similar to the situation in describing the horizontal deflection field, the barrel shaped vertical field may be produced by adding the nonuniformity by means other than controlling the deflection coil winding distribution. For example, the vertical coils may be wound to produce an anastigmatic field such as illustrated in FIG. 3*b* and a quadrupole winding located on the deflection yoke or in a separate winding located adjacent to the deflection yoke may be utilized. The quadrupole winding would have its poles located approximately 45° between the horizontal and vertical deflection axes such as illustrated in FIG. 4.

The aforementioned patent discloses a system which is entirely self-converging. This means that no dynamic convergence is required; the conventionally energized deflection coil windings are structured to provide the required particular astigmatic fields for converging the beams. In such a system utilized with picture tubes having smaller size viewing screens, substantial convergence is achieved at all points on the viewing screen by balancing the convergence condition such that the beams may be slightly underconverged at the ends of the horizontal deflection axis and slightly overconverged at the ends of the vertical deflection axis. This compromise, which results in a cost and complexity saving by eliminating all dynamic convergence apparatus and its attendant set up and servicing adjustments, results in a commercially acceptable reproduced picture on the viewing screen. However, in the larger viewing screen sizes, with increased distance between the deflection plane C of FIG. 1 and the screen, such as in a picture tube having a viewing screen diagonal measurement of 63 cm, any convergence errors are magnified and may be unacceptable. In this situation the self-converging feature may be supplemented by a simplified dynamic convergence arrangement which may utilize dynamic convergence along one deflection axis only. With such an arrangement, the horizontal deflection coils may be designed to achieve self-convergence along the horizontal deflection axis. The vertical coils may be designed to produce zero trap in the corners. This would leave vertical lines overconverged along the top and bottom portions of the raster. These errors must be apportioned so that simplified dynamic convergence can correct them. A quadrupolar winding producing a quadrupole magnetic field as illustrated in FIG. 4 can correct these overconvergence errors. In FIG. 4 the lines of flux 38 concentrate the field generally in the direction of the arrows on lines 39. This quadrupole field serves to horizontally converge vertical lines so that the entire raster is converged. A substantial cost saving it still achieved without sacrificing performance because no horizontal frequency or corner dynamic convergence currents are required. This eliminates the need for conventional dynamic convergence electromagnets and their driving current circuitry. Again, the means for generating the quadrupole field for simplified dynamic convergence is not germane to the present invention. This field may be generated by additional conductor turns wound on the deflection yoke as indicated in FIGS. 8*a* and 8*b*. This quadrapole field may also be generated by a winding disposed around the picture tube adjacent the yoke, by an unbalancing of current through the vertical deflection coils.

In addition to the design of the deflection coils for producing the beam-converging deflection fields, the aforementioned patent also discloses that the deflection field center may be aligned with the center one of the three in-line electron beams to balance the convergence condition around the edges of the viewing screen. This is accomplished by designing the deflection yoke so that its smallest inner diameter is in the order of 1–3 mm larger than the outer diameter of the neck portion of the picture tube glass envelope about which it is mounted. The yoke may then be moved transversely at right angles to the central beam axis so that the central longitudinal axis of the deflection field coincides with the center beam axis. The yoke may also be tilted if necessary to bring about the alignment which results in optimum convergence. The yoke is then secured in the aligned position by any suitable yoke mounting arrangement. As an alternative to the mechanical positioning of the yoke, the vertical and horizontal scanning currents through their respective coil halves may be unbalanced to a small degree electrically to shift the center of the electron beam deflecting field to align it with the center beam for optimum convergence. This may be accomplished by adding series impedance to one of the coil halves or by shunting some of the scanning current around one of the coil halves.

What has been described above are a number of variations of coplanar display systems utilizing no internal pole pieces which act as flux directors for converging fields. However, all of the systems do utilize the described self-converging feature alone, a self-converging feature with simplified dynamic convergence or anastigmatic deflection coils similar to coils used with conventional delta gun picture tubes plus a quadrupole winding energized at both the vertical and horizontal scanning rates for producing the required astigmatic convergence field. The self-converging or simplified converging arrangements are utilized as part of the present invention and it is to be understood that the above arrangements are illustrative of the type of self-converging arrangements which may be utilized as part of the present invention.

There is an undesirable characteristic of the above described self-converging and simplified convergence systems and that is defocussing of the individual electron beams caused primarily by the astigmatic deflection field. This does not create any significant problem with the smaller screen picture tubes, but with the large size picture tubes it can detract from picture quality. Specifically, each of the beams is compressed vertically and stretched horizontally as it is deflected in a horizontal direction, the beam spot forming an ellipse. The ellipticity becomes more pronounced as a function of the beam distance in a horizontal direction away from the center of the screen. This situation can be seen clearly by referring to FIG. 5 which illustrates the beam spot conditions at various points in the upper right hand quadrant of a viewing screen 40.

Figure 5:
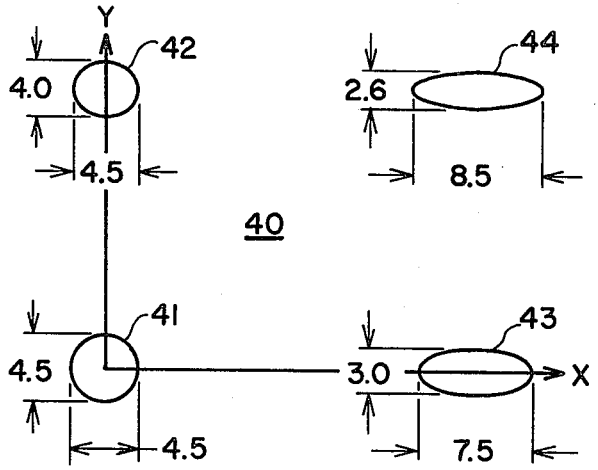
FIG. 5 illustrates a beam spot problem observed on the picture tube without the use of the invention.

In FIG. 5 the beam spot 41 at the center of the screen is round. The essentially round beam was generated by the electron gun and focussed on the screen. The dimension numbers indicate the amount of ellipticity or distortion of the beam spot at the various locations. It should be noted that the beam spot varies in size with the amount of current in the beam. The beam current varies as a function of video signal coupled to the electron beam gun assembly. Illustratively, in a wide angle large screen picture tube the beam spot may vary from a circle of about 2 mm to a circle of about 4.5 mm at the center of the viewing screen. The beam spot size will vary proportionately at other points on the viewing screen. At the end of the horizontal, or X, deflection axis the beam spot 43 has been shaped into an ellipse having a major axis measurement of 7.5 relative to the center measure of 4.5. At the corner, the spot 44 has a major elliptical axis measurement of 8.5. At the top of the vertical, or Y, deflection axis, the beam spot 42 is not changed significantly from the center spot size. Obviously, the spots 43 and 44 illustrate a degradation of the beam spot, enough to adversely affect horizontal resolution. The arrangement according to the invention permits the use of the highly desirable self-converging deflection system without accompanying undesirable defocussing of each of the electron beams.

FIGS. 6*a*–6*c* illustrate an electron gun assembly suitable for use in the inventive system. Generally, the electron gun assembly provides three in-line electron beams which are vertically elliptically shaped and which may be utilized with the above described self-converging or simplified convergence systems to significantly reduce the deflection defocussing of the beams.

In FIG. 6*a* the gun 25 comprises two glass support rods 50 on which the various grid electrodes are mounted. These electrodes include three equally-spaced coplanar cathodes 51 (one for each beam), a control grid electrode 52, a screen grid electrode 53, a first accelerating and focusing electrode 54, a second accelerating and focusing electrode 55, and a shield cup 56. All of these components are spaced along the glass rods 50 in the order named.

Each cathode 51 comprises a cathode sleeve 57, closed at the forward end by a cap 58 having an end coating 59 of electron emissive material. Each sleeve is supported in a cathode support tube 60. The tubes 60 are supported on the rods 50 by four straps 61 and 62. Each cathode 51 is indirectly heated by a heater coil 63 positioned within the sleeve 57 and having legs 64 welded to heater straps 65 and 66 mounted by studs 67 on the rods 50.

The control and screen grid electrodes 52 and 53 are two closely-spaced (about 0.23 mm apart) flat plates, each having three apertures 68R, 68G and 68B and 69R, 69G and 69B, respectively, centered with the cathode coatings 59 and aligned with the apertures of the other along a central beam path 70G and two outer beam paths 70R and 70B extending toward the picture tube screen 21. The outer beam paths 70R and 70B are equally spaced from the central beam path 70G. Preferably, the initial portions of the beam paths 70R, 70G and 70B are substantially parallel and about 5 mm apart.

The first accelerating and focusing electrode 54 comprises first and second cup-shaped members 71 and 72, respectively, jointed together at their open ends. The first cup-shaped member 71 has three medium sized (about 1.5 mm) apertures 74R, 74G and 74B close to the grid electrode 53 and aligned respectively withe the three beam paths 70R, 70G and 70B. The second cup-shaped member 72 has three large (about 4 mm) apertures 75R, 75G and 75B also aligned with the three beam paths.

The second accelerating and focusing electrode 55 is also cup-shaped and comprises a base plate portion 76 positioned close (about 1.5 mm.) to the first accelerating electrode 54 and a side wall or flange 77 extending forward toward the tube screen. The base portion 76 is formed with three apertures 78R, 78G and 78B which are preferably slightly larger (about 4.4 mm.) than the adjacent apertures 75R, 75G and 75B of electrode 54. The middle aperture 78G is aligned with the adjacent middle aperture 75G (and middle beam path 70G) to provide a substantially symmetrical beam focusing electric field between apertures 75G and 78G when electrodes 54 and 55 are energized at different voltages. The two outer apertures 78R and 78B are slightly offset outwardly with respect to the corresponding outer apertures 75R and 75B, to provide an asymmetrical electric field between each pair of outer apertures when electrodes 54 and 55 are energized, to individually focus each outer beam 70R and 70B near the screen, and also to deflect each outer beam toward the middle beam 70G to a common point of convergence with the middle beam near the screen. In the example shown, the offset of the beam apertures 78R and 78B may be about 0.15 mm.

In order to provide correction for the aforementioned beam flattening as horizontal deflection angle is increased, each beam is predistorted in the gun so that it is vertically defocused at the center of the screen resulting in vertical elongation of the undeflected beam spot. This predistortion, or preshaping, of the beams is accomplished by using vertically elongated, or preferably, vertically elliptical apertures in the electron gun assembly. In the gun assembly illustrated, both of the grids nearest the cathodes, viz., the control grid electrode 52 and the screen grid electrode 53 include vertically elliptical apertures although any other suitable beam shaping arrangement could be used. Elliptical shaping of the apertures 68R, 68G and 68B in the control grid 52 is shown in FIG. 6b and of the apertures 69R, 69G and 69B in the screen grid 53 is shown in FIG. 6c. Of course, the degree of ellipticity required depends on the specific type of tube used. However, for the center beam of a 63 cm.V 110° in-line tube as previously described having an edge electron beam spot ellipticity of 2.9/1.0 in the absence of the present invention, a vertically elliptical aperture having an ellipticity of 1.6/1.0 provide sufficient preshaping of the beam to obtain a substantially round beam at the edge of the screen. Typical aperture dimensions that meet this ellipticity requirement are approximately 0.5 mm. horizontally and approximately 0.8 mm. vertical.

The effect on the beam spot observed on the viewing screen of the inventive combination including a self-converging or simplified convergence deflection system and an electron gun assembly producing vertically elliptically shaped beams is illustrated in FIG. 7. In FIG. 7 the beam spots are shown in the upper right hand quadrant 40 of the phosphor viewing screen, similar to FIG. 5. At the center of the screen, at the crossing of the horizontal and vertical, or X and Y, deflection axis, the beam spot 41' is a vertically shaped ellipse having the ratio dimensions indicated. This vertical ellipse is retained but is slightly increased in size at the end of the vertical deflection axis as illustrated by the beam spot 42'. The significant improvement is observed at the end of the horizontal axis and in the corner by comparing the respective beam spots 43' and 44' with the corresponding spots 43 and 44 in FIG. 5. The major axis dimension of the horizontally elliptical beam spots is substantially reduced. This results in an increased resolution ability for the system such that a satisfactory reproduced picture is presented to the viewer. The effect on the beams is similar in the remaining three quadrants of the viewing screen.

The elliptical apertures in the control electrode 52 and screen electrode 53 in FIGS. 6*a*–6*c* form the three in-line beams into their vertically elliptical shapes. These elliptical beams are then focused by the substantially circular focussing and accelerating electrodes 54 and 55. The vertically disposed principal rays of each beam cross over in a horizontal line farther from the cathodes than do the horizontally disposed principal rays which cross over in a vertical line due to the action of the focussing field on the elliptical beams. To obtain minimum horizontal dimension of the beam spot on the phosphor screen, the strength of the main focus lens (the focussing potential applied to electrode 54 and 55) is adjusted to image the vertical cross-over on the phosphor screen.

FIG. 8*a* illustrates the conductor winding distribution in one quadrant of a toroidal deflection yoke suitable for use as part of the invention as applied to a display system utilizing a picture tube having a deflection angle of 110° and a viewing screen diagonal measurement of 63 cm. The reference lines X and Y represent the horizontal and vertical deflection axis, respectively, of the toroidal deflection yoke which is the deflection yoke of FIG. 1. As indicated in FIG. 8*a*, the conductors indicated by a circle form the horizontal field producing deflection coils. The conductors indicated by an *x* are representative of the vertical field producing deflection coils. The conductors indicated by a triangle are the conductors which form separate quadrupole field-producing coil winding portions which are toroidally wound about the core of the toroidal yoke. As illustrated in FIG. 8*a*, there are in this embodiment four layers of conductors which are spaced and positioned as illustrated for forming the desired coil winding portions.

FIG. 8*b* illustrates graphically the arrangement of the conductor distribution W of a deflection yoke utilized in conjunction with the invention. It is noted that the portion W in each of the quadrants I–IV is the same as shown in FIG. 8*a*. Each section extends circumferentially around the core perimeter from the X to the Y axis in each of the quadrants. These conductors are toroidally wound about the ferrite core 26. The return conductors which would appear on the outside perimeter of core 26 are not indicated in FIG. 8*b*.

What is claimed is:

1. A color display system comprising:

a color picture tube including an evacuated envelope comprising a faceplate portion and a neck portion connected by a funnel portion, a mosaic color phosphor screen on the inner surface of said faceplate, a multi-apertured color selection electrode spaced from said screen, and a coplanar electron beam gun assembly mounted in said neck for generating and directing three electron beams through said electrode to said screen;

means for statically converging said beams at the central region of said phosphor screen; and a deflection yoke assembly comprising horizontal and vertical deflection coils mounted in operating relation about said neck of said tube for deflecting said beams horizontally and vertically for forming rasters on said screen, the conductor winding distribution of said yoke assembly being selected for producing a pincushion shaped horizontal deflecting field of such an amount for causing said three beams to be substantially converged along the horizontal deflection axis and which pincushion shaped field also causes each of said beams to be distorted horizontally as they reach said screen when deflected horizontally away from the center region of said screen;

said gun assembly including apertures of at least one grid electrode being vertically elliptically shaped for causing said beams to form vertically elliptical shapes at the center of said phosphor screen for reducing the horizontal distortion of said beams caused by said deflection assembly.

2. A color display system according to claim 1 wherein the conductor distribution of said yoke assembly is further selected for producing a barrel-shaped vertical deflecting field of such an amount such that in conjunction with said pincushion shaped horizontal deflecting field produces substantial convergence of said beams at all points on said raster.

3. A color display system according to claim 1 wherein the conductor distribution of said horizontal coils is selected for producing said pincushion-shaped horizontal deflecting field.

4. A color display system according to claim 3 wherein the conductor distribution of said vertical coils is selected for producing said barrel-shaped vertical deflecting field.

5. A color display system comprising:

a color picture tube including an evacuated envelope comprising a faceplate portion and a neck portion connected by a funnel portion, a mosaic color phosphor screen on the inner surface of said faceplate, a multi-apertured color selection electrode spaced from said screen, and a coplanar electron beam gun assembly mounted in said neck for generating and directing three electron beams through said electrode to said screen;

means for statically converging said beams at the central region of said phosphor screen; and a deflection yoke assembly comprising horizontal and vertical deflection coils mounted in operating relation about said neck of said tube for deflecting said beams horizontally and vertically for forming rasters on said screen, the conductor winding distribution of said yoke assembly being selected for producing a pincushion shaped horizontal deflecting field of such an amount for causing said three beams to be substantially converged along the horizontal deflection axis and which pincushion shaped field also causes each of said beams to be distorted horizontally as they reach said screen when deflected horizontally away from the center region of said screen, the conductor distribution of said yoke assembly is further selected for producing a barrel-shaped vertical deflecting field of such an amount such that in conjunction with said pincushion shaped horizontal deflecting field produces substantial convergence of said beams at all points on said raster, said deflection yoke assembly further including means for producing a quadrupole magnetic field for converging said beams at all points on said raster;

said gun assembly including apertures of at least one grid electrode being vertically elliptically shaped for causing said beams to form vertically elliptical shapes at the center of said phosphor screen for reducing the horizontal distortion of said beams caused by said deflection assembly.

6. A color display system according to claim 5 wherein means are provided for superimposing the central longitudinal axis of the yoke deflection field with the center one of said in-line beams for optimizing the convergence of said three beams at all points on said phosphor screen.

7. A color display system according to claim 5 wherein said means for producing a quadrupole magnetic field is energized at the vertical deflection rate only.

* * * * *